US006547501B2

(12) United States Patent
Schlough

(10) Patent No.: US 6,547,501 B2
(45) Date of Patent: Apr. 15, 2003

(54) DEVICE AND METHOD FOR BINDING PRINTED PRODUCTS

(75) Inventor: James Richard Schlough, Stratham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 11 days.

(21) Appl. No.: 09/814,635

(22) Filed: Mar. 22, 2001

(65) Prior Publication Data

US 2002/0136618 A1 Sep. 26, 2002

(51) Int. Cl.[7] ..... B42C 11/00

(52) U.S. Cl. ..... 412/4; 412/1; 412/4; 412/6; 412/8; 412/9; 412/33; 412/37; 270/58.07; 270/52.08; 270/52.2; 270/52.18; 270/58.08; 271/287; 271/292; 271/294

(58) Field of Search ..... 412/1, 4, 6, 8, 412/9, 33, 37; 270/58.07, 52.08, 52.2, 52.18, 58.08; 271/287, 292, 294

(56) References Cited

U.S. PATENT DOCUMENTS 2,461,573 A * 2/1949 Schweizer
3,580,563 A * 5/1971 Bassett ..... 270/58.18
4,124,203 A * 11/1978 Muller ..... 270/52.2
4,133,521 A * 1/1979 Muller ..... 270/52.2
4,477,067 A * 10/1984 Wise ..... 270/52.2
4,556,353 A 12/1985 Ehlermann
4,925,354 A 5/1990 Cote ..... 412/8
4,988,086 A * 1/1991 Schlough ..... 270/52.2
5,082,256 A * 1/1992 Bryson ..... 270/52.2
5,213,318 A * 5/1993 Newhall ..... 270/52.2
5,251,888 A * 10/1993 Eugster ..... 198/803.11
5,269,504 A * 12/1993 Backman ..... 270/52.2
5,921,538 A * 7/1999 Schlough ..... 270/52.18
6,082,724 A * 7/2000 Kahlig et al. ..... 270/52.14
6,311,968 B1 * 11/2001 Linder et al. ..... 270/52.14

* cited by examiner

*Primary Examiner*—A. L. Wellington
*Assistant Examiner*—Mark T. Henderson
(74) *Attorney, Agent, or Firm*—Davidson, Davidson & Kappel, LLC

(57) ABSTRACT

A device for preparing a book spine includes a plurality of movable pockets, each pocket having an angled back, a packer and a spine stop at a lower end of the pocket for receiving the spine. The spine stop has a first collect position, a second position wherein the spine stop is lower with respect to the packer than in the collect position but still holds the spine, and a third position wherein the spine stop is rotated away from the spine. A method for preparing a spine is also provided.

12 Claims, 6 Drawing Sheets

DEVICE AND METHOD FOR BINDING PRINTED PRODUCTS

BACKGROUND OF THE INVENTION

The present invention relates generally to binding and more particularly to a device and method for preparing a printed product or book spine for binding.

To form books (defined herein to include all sheet and signature assemblages), sheets or signatures typically are collated or assembled so that the sheets of the book are arranged in the desired order. U.S. Pat. No. 4,988,086 discloses, for example, an apparatus and method for forming sheet material assemblages. The sheets or signatures are stacked above continuously moving assemblers or pockets and dropped one-by-one into the pockets. The bottom of the pocket can open to release an assembled, but unbound, book.

To prepare books for binding, the spine of the book is formed so that the bottom edges align. The spine will be flat if a flatback book is to be formed. If signatures rather than individual sheets are collated, the backbone of the book typically will be sawed so that individual sheets within each signature present themselves at the spine.

U.S. Pat. Nos. 4,925,354 and 4,556,353 disclose methods for applying an adhesive to the spine of a book. The book is gripped from the top by clamps to expose the spine of the book. The spine of the book has a length greater than a width of the spine, and is flat. As the spine travels in a direction parallel to the length of the spine, an adhesive is applied by rollers or applicators.

The above-referenced patents have the disadvantage that several separate devices are require to collate, register and bind the books. Moreover, transfer of the books between the collating machines, registering machines and the clamps is required. Each transfer point increases the chances for malfunction or a reduction in quality, such as bent edges or misalignment of the pages.

In addition, it is not possible with the above devices to laterally register signatures of varying product sizes in a single book.

BRIEF SUMMARY OF THE INVENTION

An object of the present invention is to provide a method and device for preparing a book spine conveyed perpendicularly to the spine. Another alternate or additional object of the present invention is to provide for individual registration in a lateral direction for each collected signature. Yet another alternate or additional object of the present invention is to permit for more efficient binding of the book spine.

Commonly-assigned U.S. patent application Ser. No. 09/570,201 filed May 12, 2000, hereby incorporated-by-reference herein, dealt with several of the problems of the prior art by having a construction in which books conveyed perpendicularly to the spine in pockets were clamped by two separate clamping mechanisms. Individual lateral registration for the signatures was not provided.

The present invention provides a method for preparing a book spine including: delivering a plurality of products into a pocket against a spine stop so as to form a book having a spine, and conveying the book perpendicularly to the spine. A single packer can be used pack the book. The packer then releases the book. A back of the pocket and the spine stop are lowered with respect to the packer so as to define a spine exposure. The packer then contacts the book again to maintain the spine exposure.

The spine stop is then moved away from the book spine, and the packer is pivoted to alter the spine angle. The spine may then be processed, for example by sawing.

"Signatures" as defined herein may include individual sheets and/or multi-sheet signatures. The pivoting preferably occurs by holding a lower section of the signatures firmly between a pivotable clamp and the packer, and then rotating each about a respective pivot.

After processing, the book spine may be returned to a home position. An inverted book cover can then be added and the process repeated to prepare the spine with the book cover for gluing, for example.

To deliver the books with the inverted cover, the packer is opened and the books may fall by gravity to a conveyor or may be removed by a gripper conveyor.

Preferably, as the signatures enter the pockets, the entering signature is held apart from the previously collated signatures, and is registered laterally. Once the entering signature is against the spine stop in the proper lateral position, the entering signature may rest against the previous collated signatures.

The present invention thus also provides a method for collecting signatures against a spine stop comprising the steps of: entering at least one first signature into a pocket so as to rest against an angled tray and a spine stop so as to form a collated book, and entering at least one second signature into the pocket, the second signature being held apart from the first signature at an upper section and contacting the first signature at the spine stop.

By holding apart the second signature from the first at the upper section, better spine registration may be achieved.

Preferably, a registration jogger is provided to be able to move the individual entering signature laterally. Thus a variety of product sizes can be registered properly in the lateral direction.

The present invention also includes a device for preparing a book spine comprising a plurality of pockets, each pocket having an angled back. Each pocket also has a packer and a spine stop at a lower end of the pocket for receiving the spine, the spine stop having a first collect position and a second position, which may be variable, wherein the spine stop is lower with respect to the packer than in the collect position. The plane of the spine in the second position is parallel to the plane of the spine in the first position. In a third position, the spine stop is rotated away from the spine.

Preferably, the packer operates in conjunction with a clamp beneath the back. The packer holds a lower part of the products against the clamp.

A packer operating lever preferably is provided to provide for a packing operation and a tighter clamping operation when the book spine is rotated.

A latch for the spine stop may be provided, as may a tray lever and latch. A clamp roller and tray level roller may also be provided.

When receiving new products, the back and the spine stop preferably form an angle with the vertical plane.

Preferably, the pockets each include at least one shutter blade to keep an entering signature away from already collected signatures. The shutter blade may then be retracted, for example by rotation, to permit the entering signature to fully contact the collected signatures. The shutter blades thus permit the signature to be fed in a vertical guided path until the lower end of the signatures enters against the spine stop. The signature is held in a position where its shorter bottom section is angled, and the longer upper section is restrained on one side by a vertical guide and on the other side by the shutter blades. A curved section in the middle of the signature is produced, which contributes to rigidity along the direction of the spine. Ajogger paddle of the registration jogger can push on the signature just above the curve on the vertical part of the signature to move the signature along its spine direction for proper lateral registration. The packer then can close against the lower end of all of the signatures, and the shutter blades may be pivoted out of the vertical path, allowing the signature to rest against the previously collected signatures.

In this way, each signature, even if having varying product sizes, can be arranged laterally in a desired position.

The latches, levers and roller, and any motions of the parts of the pocket, may be actuated by cam action.

"Book" as defined herein can mean any type of sheet or signature assemblage, including but not limited to, covered printed products, paper booklets, and magazines.

BRIEF DESCRIPTION OF THE DRAWINGS

A preferred embodiment of the present invention is described below by reference to the following drawings, in which.

DETAILED DESCRIPTION

Figure 1:
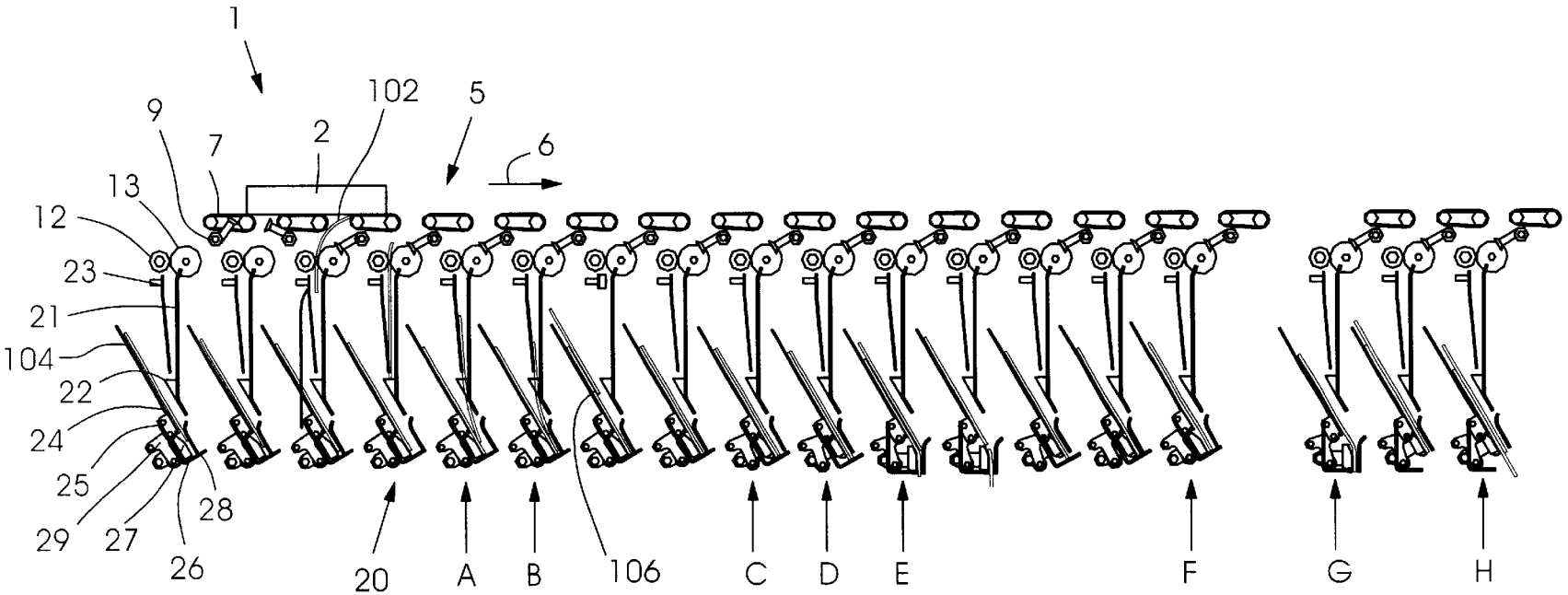
FIG. 1 shows a side view of the device for preparing a book spine according to the present invention.

FIG. 1 shows a side view of the device 1 for forming a book according to the present invention. A stack 2 of signatures sits above a plurality of compilers 5 which move in a direction 6. Each compiler 5 has a belt 7 which runs in a counterclockwise direction so that a top part of the belt has a velocity with a magnitude similar to that of the compilers 5 in direction 6. Stack of signatures 2 thus experiences a relative velocity of zero and remains in the position shown in FIG. 1 as compilers 5 move in direction 6.

Each compiler 5 also includes a pivotable suction device 9, for example a vacuum sucker pivotable about a pivot.

As compilers 5 travel beneath stack 2, suction device 9 of compiler 5 pulls a bottom signature 102 of the stack of signatures downwardly to pass between compilers 5. A caliper or sprung roller 13 of compiler 5 opens (through a rotation of shaft against the spring force) to permit the lead edge of the signature 102 to enter between the caliper roller 13 and a drive roller 12.

The signature 102 enters one of a plurality of pockets 20, which travels along god with compilers 5 in direction 6. Pockets 20 include a register jogger 21 with a jogger paddle 22, shutter blades 23, and a back 24. Back 24 is fixed to a pivot support 25 supporting a spine stop 26, which in turn supports the bottom edges of the entering signatures 102. Spine stop 26 forms a perpendicular surface to back 24, which preferably is offset 30 degrees from the vertical.

The lower edges of the signatures can be grasped between a clamp 27 and a packer 28, as will be described. Clamp 27 and packer 28 generally remain at a similar height. A cam-activated tray lever 29 can lower the back 24 and the spine stop 26 with respect to the clamp 27 and packer 28.

Figure 5:
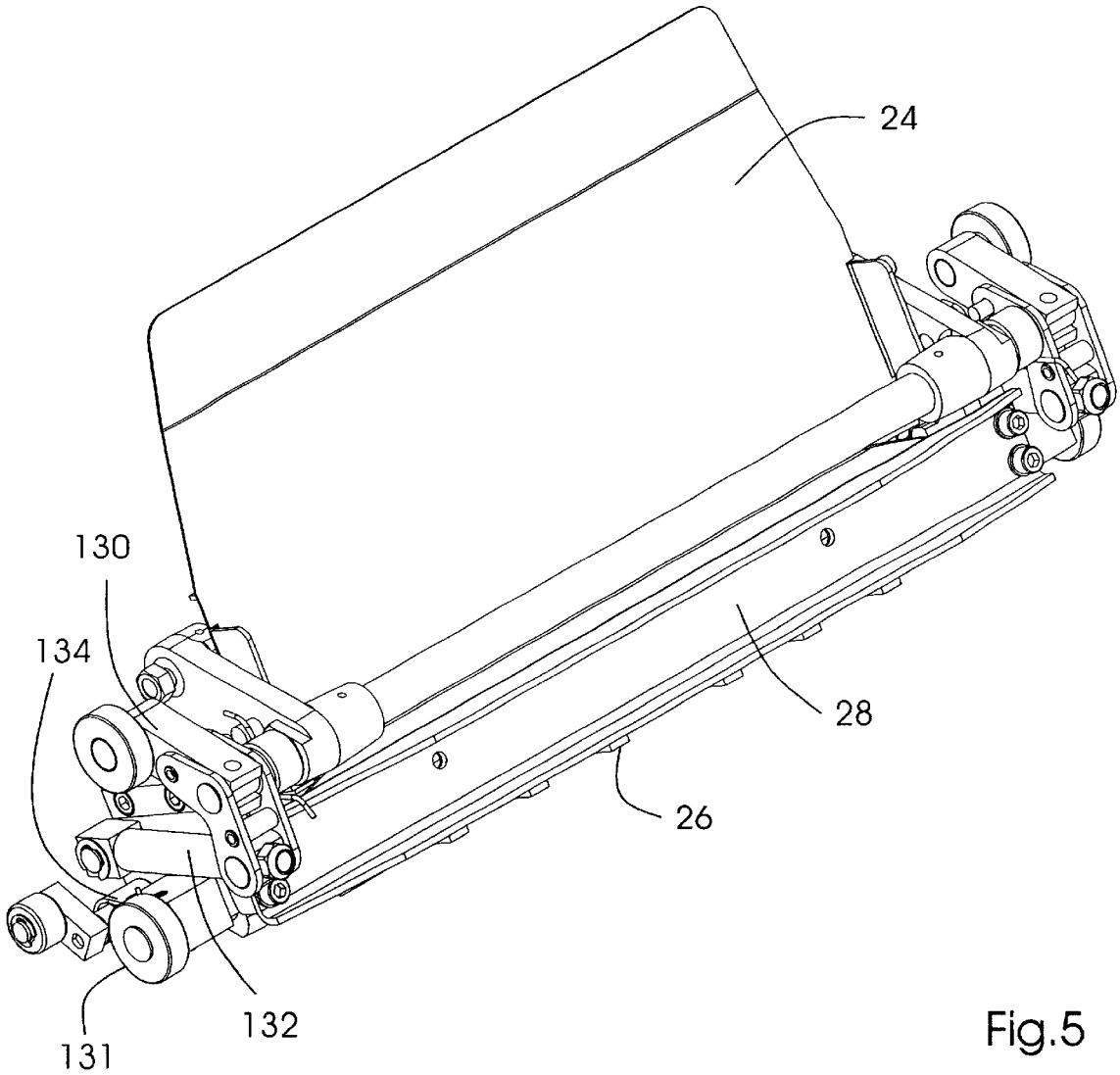
FIG. 5 shows a perspective view of the pocket of FIG. 2.
Figure 6:
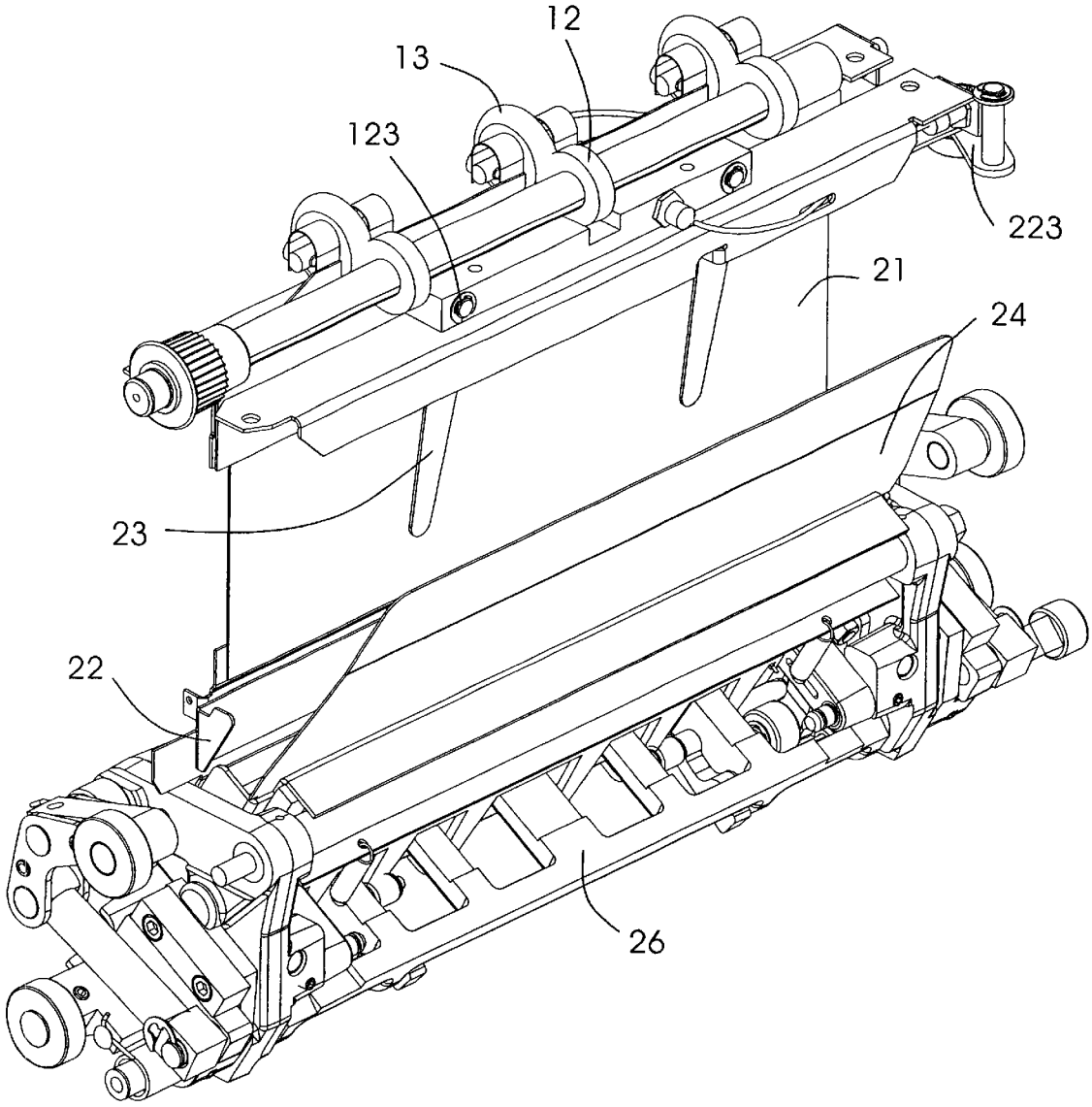
FIG. 6 shows a perspective view of the pocket of FIG. 2 also showing the jogger and shutter blades.

As shown in FIGS. 5 and 6, the spine stop 26 includes a series of fingers that interleave with notches in the lower surfaces of clamp 27 and packer 28 to eliminate any continuous gaps at the corners.

Compilers 5 and pockets 20 may be attached at one or both sides to a frame which moves along an endless track, for example in a loop.

Figure 2:
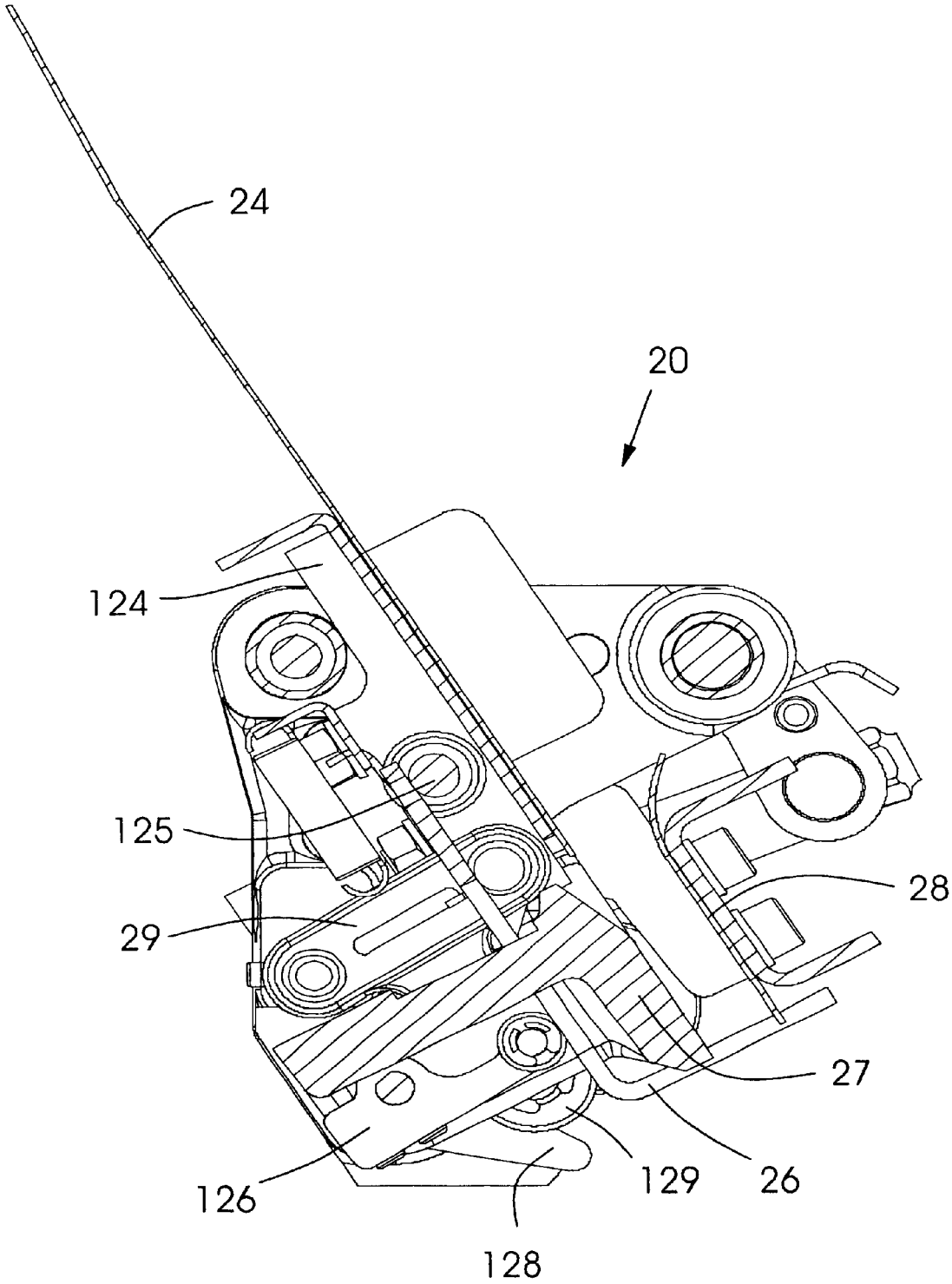
FIG. 2 shows partial side view details of a pocket of FIG. 1 in a collecting position.
Figure 4:
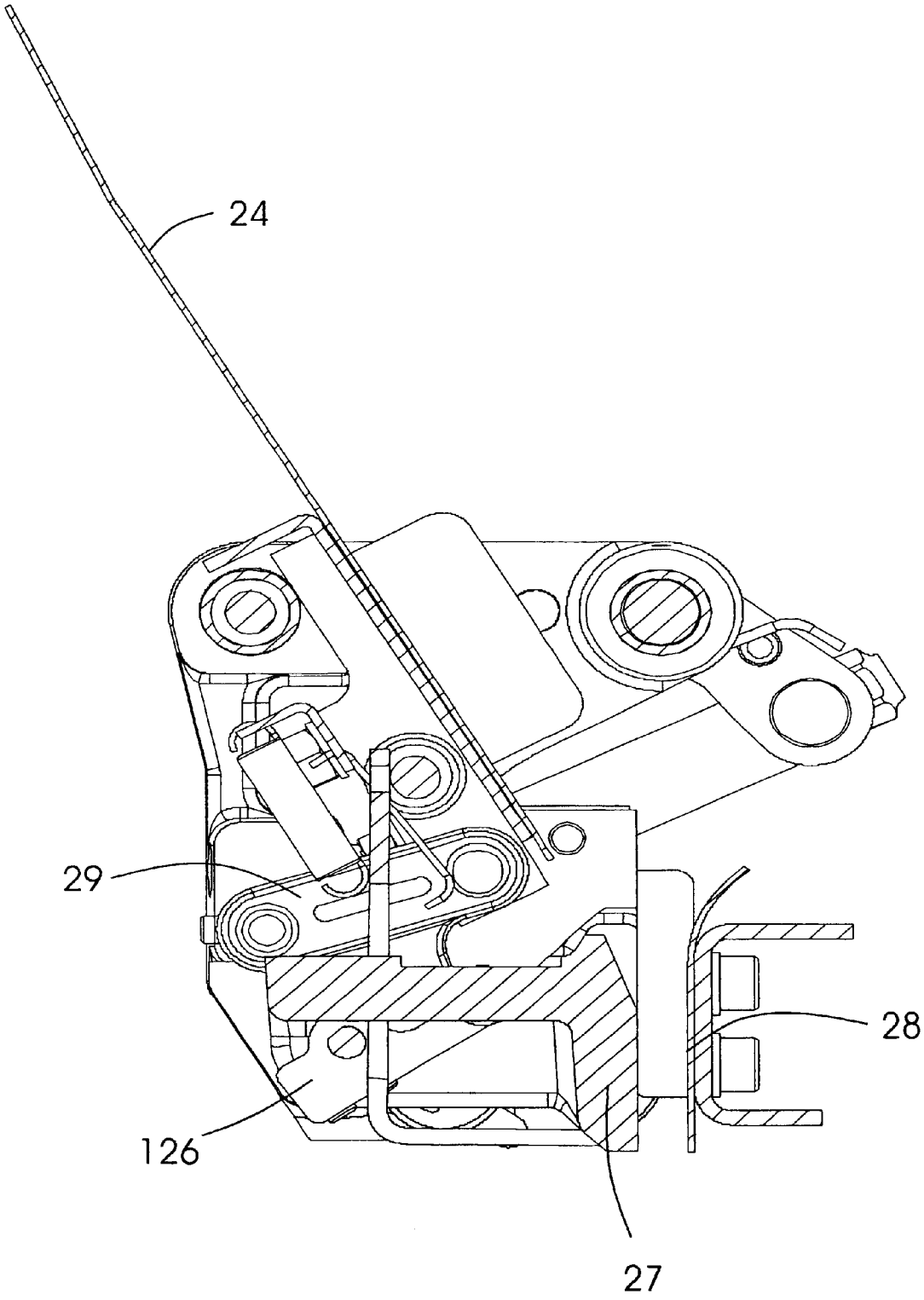
FIG. 4 shows the pocket of FIG. 2 in a third position where the spine of a book is squared.

FIG. 2 shows one of the pockets 20 in the normal or home feeding position for receiving the signatures from the stack 2, as shown by location A in FIG. 1. Back 24 is supported on a support 124, in which a pivot 125 is supported. Spine stop 26 is connected to pivot 125 and thus can rotate downwardly when a spring latch 126 is released, as shown in FIG. 4 and as indicated at station E in FIG. 1.

Supported in the frame of the pocket 20 are the clamp 27 and packer 28. Clamp 27 has a first position, shown in FIG. 2 and FIG. 3, and a second position where it is rotated downwardly, as shown in FIG. 4 and indicated at station E in FIG. 1. Packer 28 has an open position for receiving signatures as indicated at station A in FIG. 1, a closed position for packing signatures against clamp 27 as shown at station B in FIG. 1, and a rotated position shown at station E in FIG. 1 and in FIG. 4.

As shown in FIG. 1 at section A and in FIG. 6, a registration jogger 21 with a paddle 22 can act on each entering signature. 102 while packer 28 is open, with the shutter blades 23 supporting the upper end of the signature 102 so that the upper end maintains a generally vertical position. The paddle 22 can push the signature 102, just above the curve on the vertical upper part, to move the signature 102 laterally. Once proper lateral registration is achieved, packer 28 can close as shown in section B in FIG. 1 to preserve the registration. As shown in FIG. 6, shutter blades 23 then can be pivoted about a pivot 123 using a cam operating on a cam roller 223. As shown in FIG. 1, the upper part of the entering signature 102 joins the already collected signatures 104 so that a book 106 with proper registration is formed.

Figure 3:
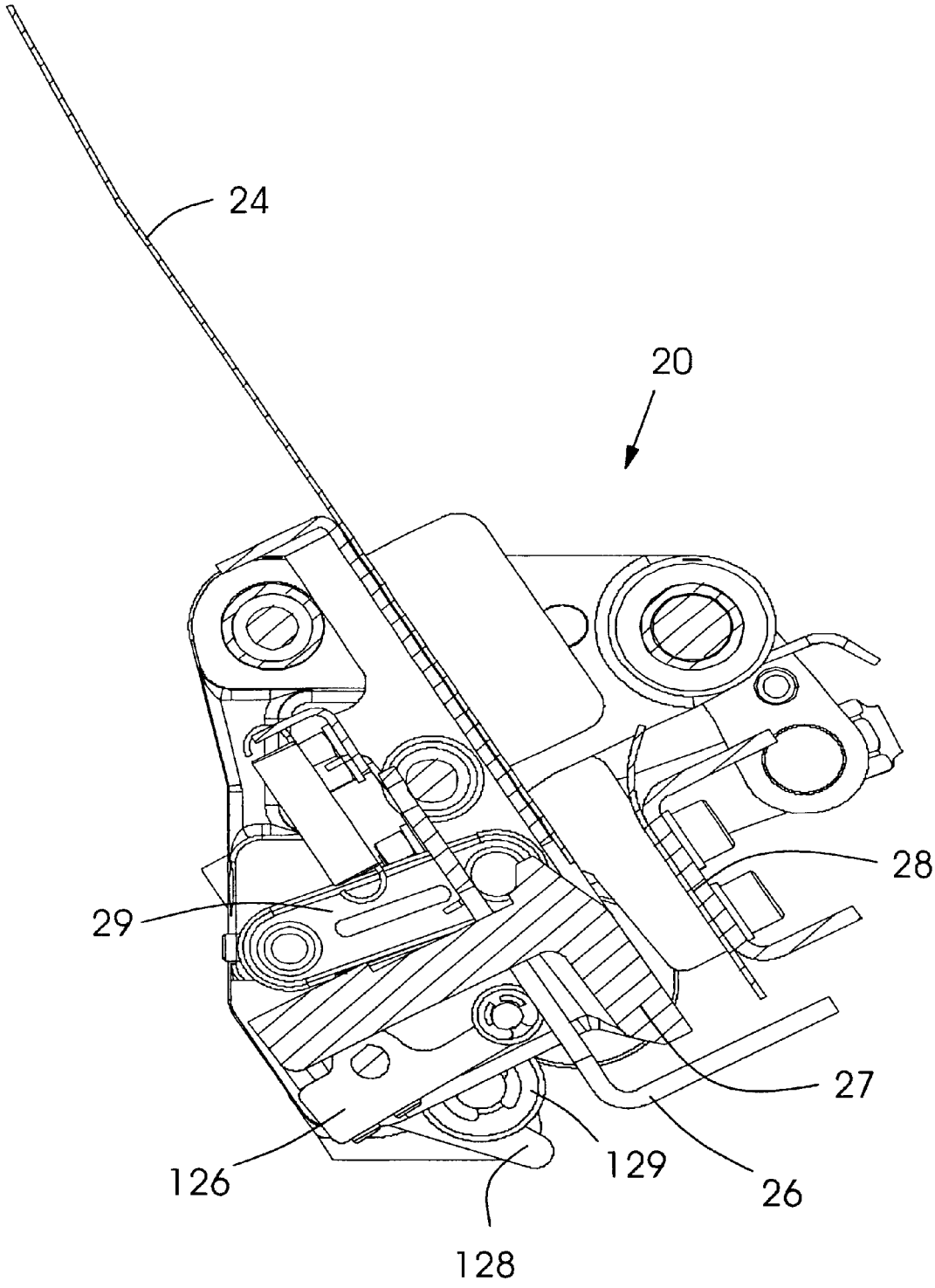
FIG. 3 shows the pocket of FIG. 2 in a second position where the spine exposure is formed.

Once the book is properly formed, the spine is exposed in a tray-drop operation to prepare for processing. As shown in section C of FIG. 1 and FIG. 3, the packer 28 opens and back 24 and spine stop 26 drop with respect to the frame and clamp 27 and packer 28 to expose a section of the spine below the packer 27 and clamp 28. The drop occurs by releasing a tray latch through a latch lever 128, as shown in FIGS. 2 and 3. The amount of exposure is variable by setting a cam interacting with roller 129 (FIGS. 2 and 3) that controls the tray lever 29 and thus the height of the back 24 and the spine stop 26.

The packer 28 is then closed on the book to set the exposure and the spine stop 26 is pivoted downwardly by releasing spine stop latch 126 shown in FIG. 2. The back 24 is dropped to its bottom or lowest position. The clamp 28 is pivoted through rollers 131 (FIG. 6) interacting with a cam rail to orient the lower section of the book vertically and present the spine horizontally for cutoff. The cam interaction works against force of a clamp torsion spring 134. At the same time packer rollers interact with opposing cams that cause springs 132 on the packer assemblies to compress, thus permitting the packer 27 to exert a greater holding force to hold the book against clamp 28. A packer operating lever 130 as shown in FIG. 5 is used to operate the packer when the lever is depressed (as shown) and compresses the springs when raised. High reaction forces on the pocket tend to be avoided using the spring and cam interactions. As shown at stage E in FIG. 1, the spine of the book is then ready for processing, in this embodiment for sawing of the spine. The height of the back 24 (and thus the book) and the saws can determine the cutoff position.

After sawing, the spine is returned to its home position, as shown in step F, by a set of fixed cams. The spine stop 26 is closed and with the back 24 is raised until the spine stop 26 makes contact with the book spine. The packer 27 is opened and the back 24 and spine stop 26 are in the home or fully raised position, where respective latches 128 and 126 latch the back 24 and stop 26 in place.

A cover then may be added to the book at station F of FIG. 1. The tray drop operation is repeated to cause the trimmed spine and untrimmed cover to be exposed at the bottom of the book, as shown in step G. Adhesive can then be placed on the spine surface by a glue roller rotating below the pockets, making tangential contact at matched velocities. The book with inverted cover is delivered by returning the packer 28 and clamp 27 be parallel to back 24 and opening the packer cam to allow the book to fall as shown in step H from the packer into the custody of a conveying device such as a gripper conveyor or belt.

The components of the pocket are then returned to the home position by pivoting the spine stop and raising the back and spine stop to the raised position, where they are latched.

It should be understood that typically a plurality of stacks 2 will sit above the moving compilers 5 and pockets 20 to form the book. The signatures may be aided in maintaining a stationary position by a hopper structure having an open bottom. Packer as defined herein can be any device for contacting sheets. All movements of the various parts of the pockets may be activated buy stationary cams.

What is claimed is:

1. A method for collecting signatures against a spine stop comprising the steps of:

entering at least one first signature into a pocket so as to rest against an angled tray and a spine stop so as to form a book; and entering at least one second signature into the pocket, the second signature being held apart from the first signature at an upper section of the second signature and the second signature contacting the first signature at the spine stop.

2. The method as recited in claim 1 further comprising conveying the book perpendicular to the spine.

3. The method as recited in claim 1 further comprising registering the at least one second signature laterally while the at least one second signature is being held apart.

4. A device for preparing a book spine comprising:

a plurality of movable pockets, each pocket having an angled back, a packer and a spine stop at a lower end of the pocket for receiving the spine, the spine stop having a first collect position, a second position wherein the spine stop is lower with respect to the packer than in the collect position but still holds the spine, and a third position wherein the spine stop is rotated away from the spine.

5. The device as recited in claim 4 wherein a plane of the spine in the second position is parallel to the plane of the spine in the first position.

6. The device as recited in claim 4 wherein each pocket has a clamp beneath the back, the packer holding a lower part of the products against the clamp.

7. The device as recited in claim 4 wherein latches hold the pockets in a home position.

8. The device as recited in claim 4 wherein each pocket further comprises a packer operating lever to provide for a packing operation.

9. The device as recited in claim 4 wherein each pocket further comprises a tray level roller for setting a height of the back.

10. The device as recited in claim 4 wherein each pocket further comprises at least one retractable shutter blade to keep an entering signature away from already collected signatures.

11. The device as recited in claim 4 further including conveying means for moving the pockets perpendicularly to the spine.

12. The device as recited in claim 4 further comprising a registration jogger for laterally registering an entering signature.

* * * * *